US008281437B2

(12) United States Patent
Hunkele

(10) Patent No.: US 8,281,437 B2
(45) Date of Patent: Oct. 9, 2012

(54) MULTI-PURPOSE TOOL

(76) Inventor: Peter Hunkele, Ashland, OR (US)

( * ) Notice: Subject to any disclaimer, the term of this patent is extended or adjusted under 35 U.S.C. 154(b) by 385 days.

(21) Appl. No.: 12/692,484

(22) Filed: Jan. 22, 2010

(65) Prior Publication Data

US 2011/0179581 A1 Jul. 28, 2011

(51) Int. Cl.

| | |
|---|---|
| ***E21C 37/22*** | (2006.01) |
| ***B26B 11/00*** | (2006.01) |
| ***B25B 7/22*** | (2006.01) |
| ***B25B 23/00*** | (2006.01) |
| ***B67B 7/00*** | (2006.01) |
| ***B67B 7/44*** | (2006.01) |
| ***F41C 27/18*** | (2006.01) |

(52) U.S. Cl. ..... 7/118; 7/104; 7/134; 7/151; 7/152; 7/153; 7/154; 7/155; 7/156; 7/158; 81/3.09; 81/440; 30/155

(58) Field of Classification Search ..... 7/104, 118, 7/134, 151–156, 158; 81/3.09, 440
See application file for complete search history.

(56) References Cited

U.S. PATENT DOCUMENTS

| | | | | |
|---|---|---|---|---|
| 1,199,651 | A | 9/1916 | Arbanasin | |
| 1,287,413 | A | 12/1918 | Parrella | |
| 1,956,405 | A | 3/1933 | Toman | |
| 2,578,983 | A | 2/1947 | Primak | |
| 2,886,994 | A * | 5/1959 | Hanson | 81/3.35 |
| 3,909,860 | A | 10/1975 | Cantales | |
| 5,103,520 | A | 4/1992 | Mazzo | |
| 5,829,965 | A | 11/1998 | Rubalcava | |
| 6,032,553 | A | 3/2000 | Brucart Puig et al. | |
| 6,289,768 | B1 | 9/2001 | Anderson et al. | |
| 6,397,704 | B1 | 6/2002 | Olaneta | |
| 6,752,040 | B1 | 6/2004 | Paul-Alexandre et al. | |
| 6,957,599 | B2 | 10/2005 | Corredor et al. | |
| 7,004,049 | B2 | 2/2006 | So | |
| 7,055,200 | B2 * | 6/2006 | Lion et al. | 7/113 |
| 2005/0183547 | A1 | 8/2005 | Corredor et al. | |
| 2006/0207390 | A1 | 9/2006 | Kehoe | |
| 2011/0119835 | A1 * | 5/2011 | Bates et al. | 7/155 |

FOREIGN PATENT DOCUMENTS

| | | | |
|---|---|---|---|
| DE | 20 2004 017 766 | U1 | 11/2004 |
| EP | 1 334 806 | A1 | 8/2003 |

* cited by examiner

*Primary Examiner* — Monica Carter
*Assistant Examiner* — Danny Hong
(74) *Attorney, Agent, or Firm* — Jerry Haynes Law

(57) ABSTRACT

A multi-purpose tool includes a tool handle and any combination of a bottle opener, a corkscrew, a zester, a lemon/lime peeler, a cutting blade and a wine bottle opener provided on the tool handle.

10 Claims, 2 Drawing Sheets

MULTI-PURPOSE TOOL

FIELD OF THE INVENTION

The disclosure generally relates to tools used by food and beverage servers. More particularly, the disclosure relates to a multi-purpose tool having various types of tools which are combined into a single unit and are useful in preparing and serving food and beverages and the like.

BACKGROUND OF THE INVENTION

Bartenders, waiters and other persons who serve food, beverages, refreshments and the like frequently encounter the need for a variety of different types of tools. For example, in some instances a knife with a sharp or serrated blade may be necessary to open boxes, cartons and the like in which a food or beverage may be packaged. Can and bottle openers are often used to open beverage-containing cans and bottles. A zester may be necessary at times to obtain zest from lemons, oranges or other citrus fruit for flavoring of a food or beverage. A wine defoiler may be used to cut foil on a wine bottle or the like. In a typical bar or other area in which a bartender, waiter or other preparer or server of food or beverage works, however, these tools are often disparate or physically-discrete units and therefore must be found and used separately. This drawback tends to clutter the bar or other work area and decreases the efficiency of the bartender or other server since the server must individually locate each tool prior to use. Moreover, the need to separately purchase multiple tools may increase the expense of using such tools.

Therefore, a multi-purpose tool having various types of tools which are combined into a single unit and are useful in preparing and serving food and beverages and the like is needed.

SUMMARY OF THE INVENTION

The disclosure is generally directed to a multi-purpose tool. An illustrative embodiment of the multi-purpose tool includes a tool handle and any combination of a bottle opener, a corkscrew, a zester, a lemon/lime peeler, a cutting blade and a wine bottle opener provided on the tool handle.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 2:
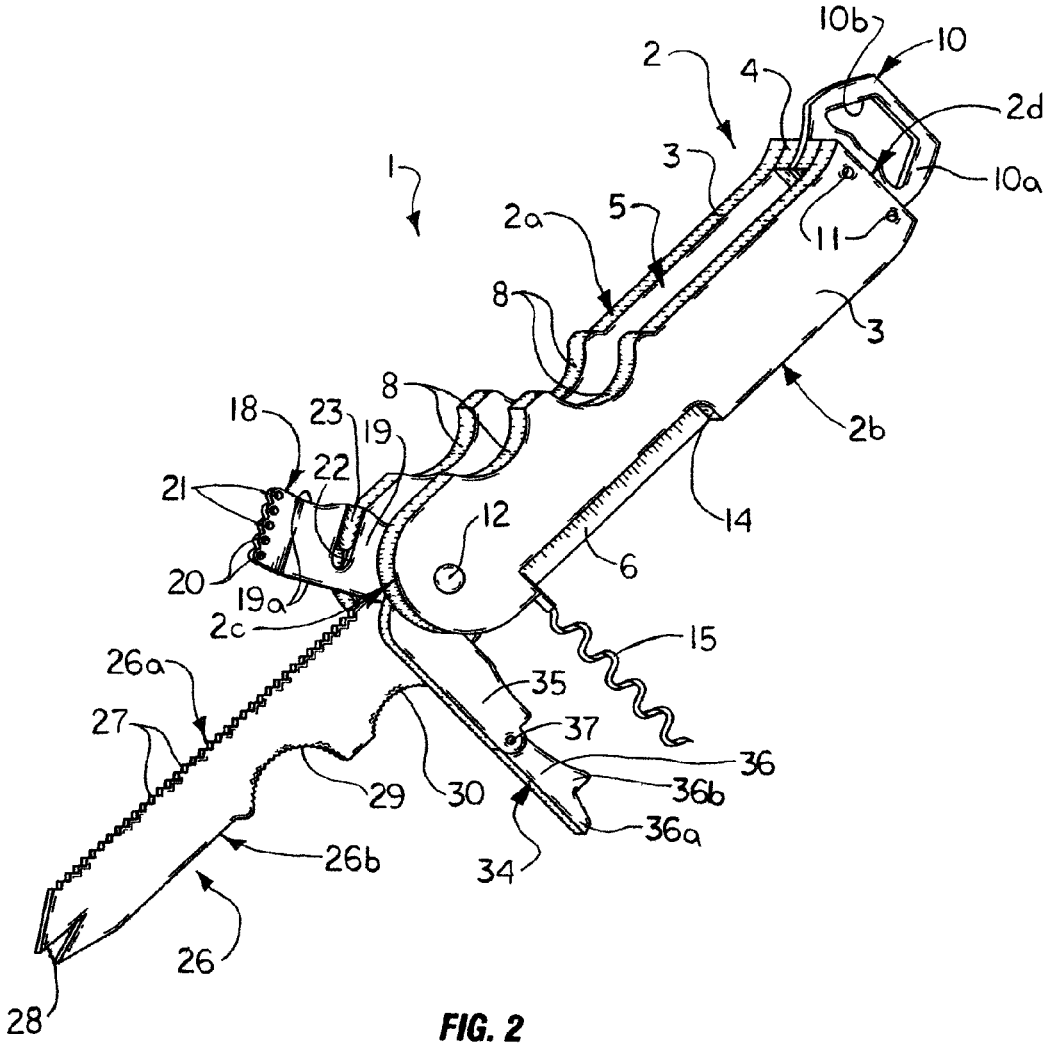
FIG. 2 is a perspective view of an illustrative embodiment of the multi-purpose tool, with the tools in an open configuration.

Referring to the drawings, an illustrative embodiment of the multi-purpose tool is generally indicated by reference numeral 1. As will be hereinafter further described, the multi-purpose tool 1 combines or consolidates various tools which may be useful to a bartender, waiter or other preparer and/or server of food and/or beverages and the like into a single unit to reduce the tendency of the server to inadvertently lose or misplace the tools as well as to reduce clutter in a bar or other food and/or beverage preparation area, increase server efficiency and reduce costs by eliminating the need to purchase individual tools. The multi-purpose tool 1 includes a tool handle 2 which may be generally elongated, as illustrated. In some embodiments the tool handle 2 may have a generally elongated first handle side 2*a*, a generally elongated second handle side 2*b* generally parallel to the first handle side 2*a*, a first handle end 2*c* and a second handle end 2*d* opposite the first handle end 2*c*. As illustrated in FIG. 2, the tool handle 2 may include a pair of generally elongated, parallel, spaced-apart handle plates 3. An end handle plate spacer 4 may be interposed between the handle plates 3 at the second handle end 2*d* of the tool handle 2. An elongated side handle plate spacer 6 may be provided between the handle plates 3 at the second handle side 2*b* of the tool handle 2. A handle interior 5 may be defined by and between the handle plates 3, the end handle plate spacer 4 and the side handle plate spacer 6. At least one pair of finger grip notches 8 may be provided in the first handle side 2*a* of the tool handle 2. In some embodiments, two adjacent pairs of finger grip notches 8 may be provided in the first handle side 2*a* of the tool handle 2, as illustrated in FIG. 2. In some embodiments, the tool handle 2 of the multi-purpose tool 1 may have a length of about 8.5", although the tool handle 2 may have alternative lengths in other embodiments.

A bottle opener 10 may be provided at the second handle end 2*d* of the tool handle 2. The bottle opener 10 may include a bottle opener frame 10*a* having a bottle opener aperture 10*b*. A pair of bottle opener attachment pins 11 may attach the bottle opener frame 10*a* of the bottle opener 10 to the end handle plate spacer 4 or other element or elements of the tool handle 2. In some embodiments, the bottle opener 10 may have a length of about ¾", although the bottle opener 10 may have alternative lengths in other embodiments.

A corkscrew 15 may be provided on the handle 2. In some embodiments, the corkscrew 15 may be pivotally attached to the handle 2 via a corkscrew pivot pin 16 (FIG. 1) generally between the first handle end 2*c* and the second handle end 2*d*. A generally elongated corkscrew cavity 14 may be provided in the tool handle 2. In some embodiments, the corkscrew cavity 14 may be provided in one of the handle plates 3 such as at the second handle side 2*b* of the tool handle 2, for example and without limitation. Accordingly, the corkscrew 15 can be selectively pivoted between a folded, storage position in the corkscrew cavity 14, as illustrated in phantom in FIG. 1, and an extended, functional position as illustrated in solid lines in FIGS. 1 and 2.

A zester 18 may be selectively extendable from the tool handle 2. The zester 18 may have a conventional design with a zester blade 19 the distal or extending end of which terminates in multiple zester openings 20 and zester rims 21 at the respective zester openings 20. The zester blade 19 of the zester 18 may be pivotally attached to the tool handle 2. In some embodiments, a pivot pin 12 may pivotally attach the zester blade 19 of the zester 18 to the first blade end 2*c* of the tool handle 2. The zester blade 19 of the zester 18 may be selectively folded into the handle interior 5 for storage, as illustrated in phantom in FIG. 1, or may be extended from the handle interior 5 for use, as illustrated in solid lines in FIG. 1. In some embodiments the zester blade 19 may have a length of about 1.5", although the zester blade 19 may have alternative lengths in other embodiments.

Figure 1:
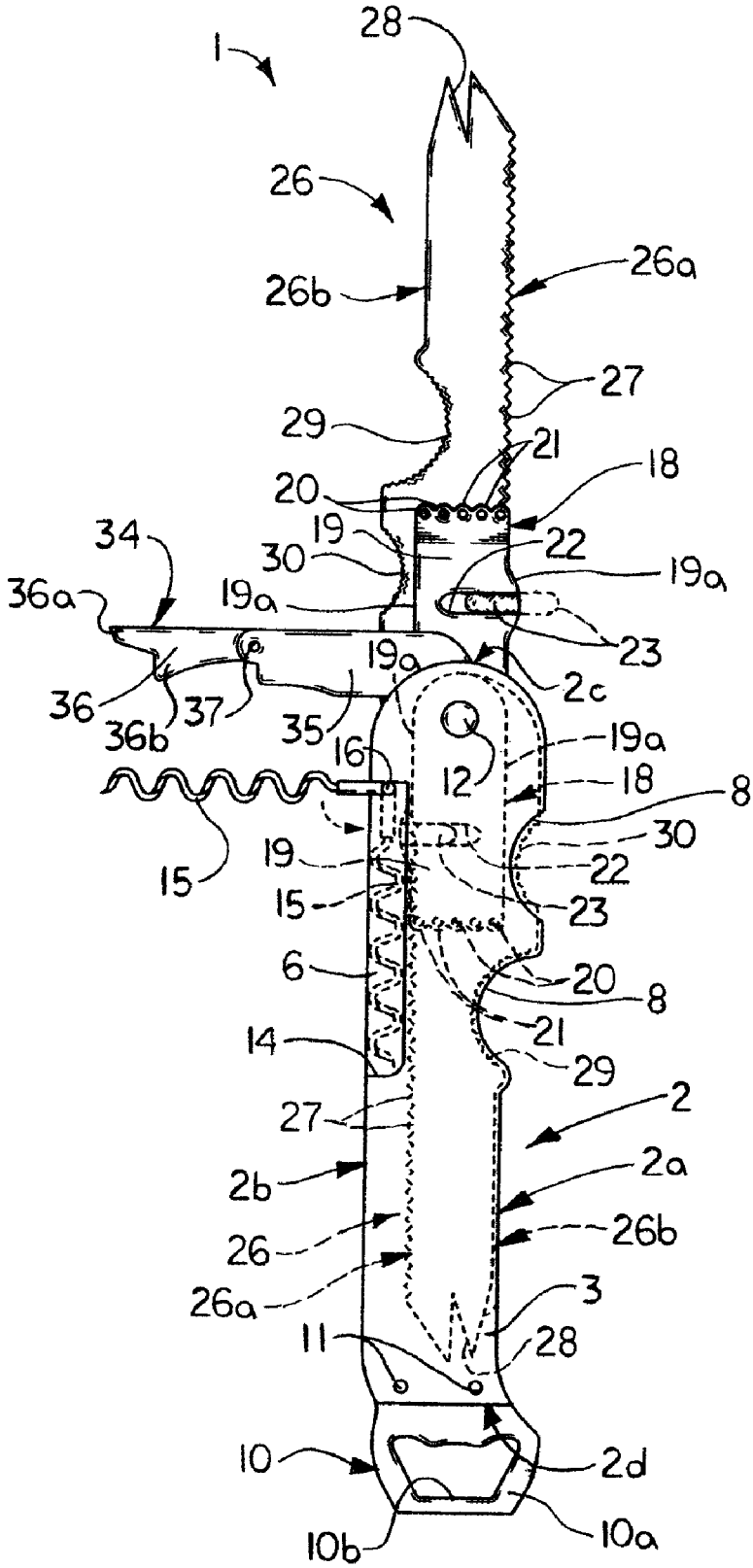
FIG. 1 is a side view of an illustrative embodiment of the multi-purpose tool, with various tools of the multi-purpose tool illustrated in an open configuration.

As further illustrated in FIGS. 1 and 2, in some embodiments a peeler cavity 22 may be provided in a blade edge 19*a* of the zester blade 19 of the zester 18. The peeler cavity 22 may be oriented in generally perpendicular relationship with respect to the longitudinal axis of the zester blade 19. A lemon/lime peeler 23 may be selectively retracted in the peeler cavity 22 for storage and extended from the peeler cavity 22 beyond the blade edge 19*a* for use, which will be hereinafter described.

A cutting blade 26 may be selectively extendable from the tool handle 2. The cutting blade 26 may have a generally elongated first blade edge 26*a* and a generally elongated second blade edge 26*b* which are disposed in parallel, spaced-apart relationship with respect to each other. Multiple blade serrations 27 may be provided on the first blade edge 26*a* of the cutting blade 26. In some embodiments, a garnish spear 28 may terminate the extending or distal end of the cutting blade 26. A wine defoiler 29, which may be serrated, may be provided in the second blade edge 26*b* of the cutting blade 26. In some embodiments, a blade notch 30 may be provided in the second blade edge 26*b* in generally spaced-apart relationship to the wine defoiler 29. In some embodiments, the cutting blade 26 may have a length of about 5.5". When the cutting blade 26 is opened, as illustrated in FIGS. 1 and 2, the overall length of the multi-purpose tool 1 may be about 14". In other embodiments, the cutting blade 26 and the multi-purpose tool 1 may have alternative lengths.

The cutting blade 26 may be pivotally attached to the tool handle 2. In some embodiments, the pivot pin 12 may pivotally attach the cutting blade 26 to the first blade end 2*c* of the tool handle 2. The cutting blade 26 may be selectively folded into the handle interior 5 of the tool handle 2 for storage, as illustrated in phantom in FIG. 1, or extended from the handle interior 5 for use, as illustrated in solid lines in FIGS. 1 and 2.

A wine bottle opener 34 may be selectively extendable from the tool handle 2. The wine bottle opener 34 may include a generally elongated opener base 35 which may be pivotally attached to the tool handle 2 such as via the pivot pin 12. An opener blade 36 having a blade tip 36*a* may be pivotally attached to the opener base 35 at a blade pivot pin 37. A blade protuberance 36*b* may extend from opener blade 36 between the blade tip 36*a* and the blade pivot pin 37. The wine bottle opener 34 may be selectively folded into the handle interior 5 of the tool handle 2 for storage or extended from the handle interior 5 for use. In FIGS. 1 and 2, the wine bottle opener 34 is illustrated in a partially-opened position.

In typical application, the multi-purpose tool 1 is used by a bartender, waiter or other server in the preparation of food and/or beverage as the server grasps the tool handle 2. When none of the tools is in use, the corkscrew 14 may normally be folded into the corkscrew cavity 14 and the zester 18 and the cutting blade 26 and the wine bottle opener 34 folded into the handle interior 5 of the tool handle 2. The lemon/lime peeler 23 is typically retracted into the peeler cavity 22 provided in the zester blade 19 of the zester 18. Accordingly, the multi-purpose tool 1 is sufficiently compact to enable the bartender, waiter or other server to carry the multi-purpose tool 1 on his or her person or store the multi-purpose tool 1 at a bar or other food and/or beverage preparation area in a space-efficient manner.

The various tools of the multi-purpose tool 1 can be selectively and individually used as a server deems necessary throughout the preparation or serving of food and/or beverage. For example, the bottle opener 10 can be used in the conventional manner to remove caps from beverage-containing bottles. The corkscrew 15 can be selectively extended from the corkscrew cavity 14 and used to remove a cork from a wine bottle. The zester 18 can be selectively extended from the handle interior 5 of the tool handle 2 and used to remove zest from an orange, lemon or other citrus fruit for the purpose of flavoring a food or beverage with the zest. The lemon/lime peeler 23 can be selectively extended from the peeler cavity 22 provided in the zester blade 19 of the extended zester 18 and used to peel a lemon or lime. The cutting blade 26 can be selectively extended from the handle interior 5 of the tool handle 2 and the blade serrations 27 used to cut and open a box or carton in which a food or beverage may be packaged. The garnish spear 28 provided in the distal or extending end of the cutting blade 26 can be used to spear a piece of fruit or the like for garnishing of food or beverage with the fruit. The wine defoiler 29 can be used to cut foil on a wine bottle preparatory to opening of the wine bottle. The wine bottle opener 34 can be selectively extended from the handle interior 5 of the tool handle 2 and used to open a wine bottle typically in the conventional manner. It will be apparent to those skilled in the art that a variety of alternative applications of the multi-purpose tool 1 are possible.

It will be appreciated by those skilled in the art that the multi-purpose tool 1 combines or consolidates a variety of tools which may be useful to a bartender, waiter or other server in the preparation and/or serving of food and/or beverage. Therefore, the multi-purpose tool 1 can be easily carried on the server's person or stored in a space-efficient manner at a bar or other beverage or food preparation area. Moreover, the multi-purpose tool 1 centralizes the tools such that the tools are easy for the server to find and use. Consequently, the server can more quickly and efficiently serve food and/or beverage patrons, particularly under busy service conditions, since the need to individually locate each tool as it is needed for food and/or beverage preparation is eliminated. Moreover, centralization of the various tools in the multi-purpose tool 1 eliminates or reduces cluttering of the bar or other food and/or beverage preparation area and may reduce the expense which would otherwise be required in purchasing the individual tools.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A multi-purpose tool, comprising:

a tool handle having opposite first and second handle sides and opposite first and second handle ends;

a zester, a cutting blade and a wine bottle opener pivotally carried by the handle at the first handle end, wherein the zester comprises a zester blade carried by the tool handle and a plurality of zester openings and a plurality of zester rims provided in the zester blade;

a lemon/lime peeler carried by the zester;

a peeler cavity provided in the zester blade of the zester and wherein the lemon/lime peeler is extendable from the peeler cavity;

a bottle opener carried by the tool handle at the second handle end; and a corkscrew carried by the tool handle generally between the first and second handle ends.

2. The multi-purpose tool of claim 1 further comprising a garnish spear provided in the cutting blade.

3. The multi-purpose tool of claim 1 further comprising a corkscrew cavity provided in the tool handle and wherein the corkscrew is retractable into the corkscrew cavity.

4. The multi-purpose tool of claim 1 wherein the bottle opener comprises a bottle opener frame carried by the tool handle and a bottle opener aperture extending through the bottle opener frame.

5. The multi-purpose tool of claim 1 wherein the wine bottle opener comprises an opener base carried by the tool handle and an opener blade having a blade tip and a blade protuberance carried by the opener base.

6. A multi-purpose tool, comprising:

a generally elongated tool handle having a pair of generally elongated and spaced-apart handle plates, a handle interior, opposite first and second handle sides and opposite first and second handle ends;

a zester having a zester blade pivotally carried by the handle at the first handle end and a plurality of zester openings and a plurality of zester rims provided in the zester blade;

a cutting blade pivotally carried by the handle at the first handle end;

a garnish spear and a wine defoiler provided in the cutting blade;

a wine bottle opener pivotally carried by the handle at the first handle end;

a peeler cavity provided in the zester blade of the zester and a lemon/lime peeler extendable from the peeler cavity;

a bottle opener carried by the tool handle at the second handle end; and a corkscrew carried by the tool handle generally between the first and second handle ends.

7. The multi-purpose tool of claim 6 wherein the cutting blade has a first blade edge and a second blade edge generally parallel to the first blade edge and further comprising a plurality of blade serrations provided in the first blade edge and wherein the wine defoiler is provided in the second blade edge.

8. The multi-purpose tool of claim 6 wherein the peeler cavity is disposed in generally perpendicular relationship with respect to a longitudinal axis of the zester blade.

9. The multi-purpose tool of claim 6 further comprising a corkscrew cavity provided in the tool handle and wherein the corkscrew is retractable into and extendable from the corkscrew cavity.

10. The multi-purpose tool of claim 6 wherein the wine bottle opener comprises an opener base pivotally carried by the tool handle and an opener blade having a blade tip and a blade protuberance carried by the opener base.

* * * * *